United States Patent [19]

Dungs et al.

[11] Patent Number: 4,601,728

[45] Date of Patent: Jul. 22, 1986

[54] METHOD AND APPARATUS FOR PREPARING A MATERIAL FOR HOT BRIQUETTING

[75] Inventors: Horst Dungs, Herne; Franz Beckmann, Aachen, both of Fed. Rep. of Germany; Henri Birscheidt, Lintgen, Luxembourg

[73] Assignee: Firma Carl Still GmbH & Co. KG, Fed. Rep. of Germany

[21] Appl. No.: 732,757

[22] PCT Filed: Sep. 4, 1984

[86] PCT No.: PCT/EP84/00266

§ 371 Date: Apr. 30, 1985

§ 102(e) Date: Apr. 30, 1985

[87] PCT Pub. No.: WO85/01061

PCT Pub. Date: Mar. 14, 1985

[30] Foreign Application Priority Data

Sep. 6, 1983 [DE] Fed. Rep. of Germany ..... 3332053

[51] Int. Cl.[4] ..... C10L 5/06; B30B 11/00

[52] U.S. Cl. ..... 44/10 G; 44/10 H; 44/13; 425/237; 264/297.6

[58] Field of Search ..... 44/10 E, 10 H, 10 J, 44/11-13; 100/92, 156, 173, 176, 907; 425/237; 264/297.6

[56] References Cited

U.S. PATENT DOCUMENTS

| | | | |
|---|---|---|---|
| 683,268 | 9/1901 | Gardner | 44/13 |
| 2,843,879 | 7/1958 | Komarek et al. | 425/237 |
| 3,593,378 | 7/1971 | Metrailer | 425/362 |
| 4,181,502 | 1/1980 | Weber et al. | 44/10 H |
| 4,248,603 | 2/1981 | Weber et al. | 44/10 J |
| 4,411,611 | 10/1983 | Ohtawa et al. | 425/237 |

FOREIGN PATENT DOCUMENTS

| | | | |
|---|---|---|---|
| 2031041 | 11/1970 | France | 44/13 |

*Primary Examiner*—Carl F. Dees

*Attorney, Agent, or Firm*—McGlew and Tuttle

[57] ABSTRACT

The invention relates to a method of preparing material for hot briquetting by pyrolytic decomposition of bituminous coal in mixture with thermally widely stable substances at a temperature of 450° to 530° C., and to a suitable apparatus for carrying out this method. In a travelling bed reactor, the briquetting material is exposed to the pyrolytic decomposition of the bituminous coal component, and is held in continuous mixing and kneading motion. For this purpose, the briquetting material is moved initially in a rotational mixing and kneading motion predominantly at levels parallel to the plane of the axes of rollers of the briquetting press, during which motion it migrates downwardly by gravity at an average speed of less than 3 centimeters per second, whereupon, at the end of this motion, it is uniformly distributed by a rotational motion over the entire width of the rollers.

12 Claims, 4 Drawing Figures

FIG. 2
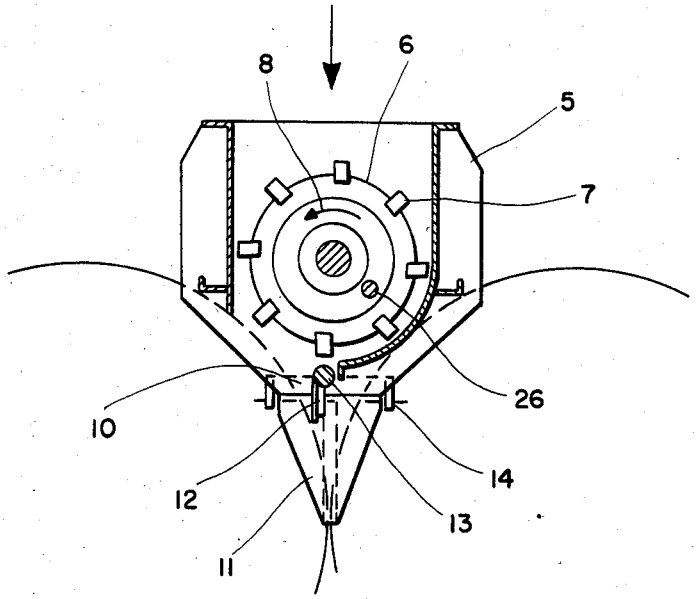
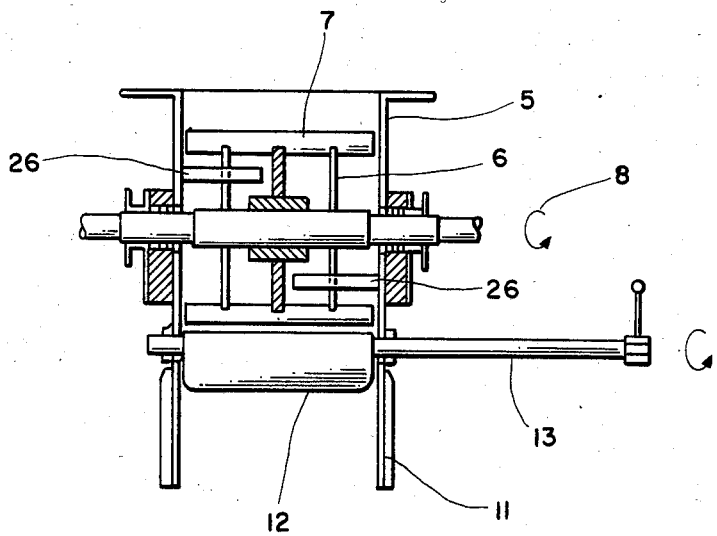
FIG. 3

METHOD AND APPARATUS FOR PREPARING A MATERIAL FOR HOT BRIQUETTING

FIELD AND BACKGROUND OF THE INVENTION

The invention relates to a method of preparing a material for hot briquetting and to an apparatus for carrying out the method.

A method of this kind for preparing a briquetting material is known from German Pat. Nos. 15 71 710 and 16 71 377. The methods described in these two patents relate particularly to measures aimed at the recovery of some of the crude tar from the briquetting material during the compaction. According to German Pat. No. 15 71 710, the yield of crude tar should range between 0.2 and 0.8%, and according to German Pat. No. 16 71 377,between 0.07 and 0.2%. It was primarily intended to obtain a maximum tar extraction from the briquetting material. Indicated as important features of the method are mixing temperatures of 450° C. to 530° C., and a dwell time of the briquetting material of 1 to 15 minutes. It has been found in this connection that what reaches the briquetting press is not always a uniformly mixed briquetting material, and that particularly the degassing and tar removal vary. Already in briquetting presses having a roll width of more than 400 mm, this drawback resulted in a reduction of the total output to less than about 7 tons per hour.

SUMMARY OF THE INVENTION

The invention is directed to a method and apparatus for preparing a material for hot briquetting having a consistency as uniform as possible, to spread this material uniformly over briquetting press rolls, even such having a width in excess of 400 mm, to always obtain briquettes with the same consistency and strength, and to ensure very high outputs of more than 7 tons per hour, up to 70 tons per hour.

In accordance with the invention, this is obtained by providing the features of the main claim.

Underlying the invention is the experience that what matters is particularly the periods of dwell in the various zones through which the briquetting material passes. First, it is necessary to mix the individual components having unequal temperatures with each other very quickly and effectively, and to provide enough time for the pyrolitic process within the reactor.

The briquetting material should remain in the reactor for a time sufficient for a satisfactory pyrolysis and degasification since insufficiently degassed briquetting material, especially if detarred, tends to burst again after being compacted. On the other hand, an excessive degasification involves a risk that the bituminous coal loses its binding capacity and the product becomes sandy and thus highly susceptible to abrasion. Finally, in accordance with the invention, the briquetting material should be distributed, within a certain time and under certain conditions, over the entire width of the briquetting rolls.

According to the invention, the briquetting material is to be kept in the traveling bed reactor in continuous mixing and kneading motion, namely, initially, in a rotational mixing and kneading motion predominantly at levels parallel to the plane of the roll axes while at the same time migrating downwardly by gravity at an average speed of less than 3 centimeters per second, and toward the end, in a rotational motion substantially perpendicular to the initial motion, to be distributed uniformly over the entire width of the briquetting rolls. Particularly the interaction between the horizontal mixing and kneading motion and the subsequent vertical rotational motion results in a very uniform consistency of the briquetting material over the entire width of rolls, so that even double roll presses with roll width far exceeding 400 mm and having very high outputs can be supplied uniformly.

It has been found advisable to produce the mixing and kneading motion, in accordance with the invention, by means of at least one stirring mechanism having stirring arms which rotate at an average circumferential speed of 1 to 4 meters per second, and lower stirring and distributing arms which rotate at the same time about a substantially horizontal axis at a circumferential speed of 0.5 to 2.5 meters per second. It is further advantageous in this connection to provide for the dwell times of the material under horizontal mixing and kneading motion and under vertical motion a ratio of 4 to 1. Along with the composition of the mixture supplied to the traveling bed reactor, the rotational motions and the speed ratios of the material within the reactor are of critical importance. By keeping to the limits indicated by the invention, a supply from the reactor to the double roll press of a mixture well capable of being briquetted is guaranteed in any case.

With press outputs exceeding 12 tons per hour, it is further advisable and in accordance with the invention to keep the total dwell period of the mixture within the reactor below eight minutes. At the speeds provided by the invention, even with such press outputs, a satisfactory degasification is ensured and no clogging in the traveling bed reactor can be expected.

According to claim 6, in a space which is secured against the atmosphere of the chamber of the press, the briquetting material is precompacted and uniformly spread over the entire width of the rolls. Air is thus prevented from penetrating into the zone where the briquetting material is fed to the double roll press, and no explosive mixture can form. At the outlet of the double roll press, the briquettes drop into an open space, so that the press can be supervised in a simple way.

For carrying out the inventive method, a traveling bed reactor in accordance with the preamble of claim 7 has proved particularly satisfactory, in which horizontally rotating stirring arms provided in an upper region are about 1.5 to 5 times, preferably 1.5 to 3 times, longer than stirring arms provided in the lower region. By means of this mechanism and with mutually equal angular speeds in the upper and lower regions, different average speeds of the briquetting material are obtained. A far higher circumferential speed is available in the upper region, for mixing the charged constituents. These lengths of the stirring arms in the upper and lower pyrolysis regions are related to the features of claim 5 concerning the outer diameter of the traveling bed reactor. Since the diameter of the reactor is considerably larger in the upper region, a much larger sectional area is available for the degasification gas escaping upwardly, and a relatively low discharge velocity of the gas can be maintained. This makes sure that only very small amounts of fine dust particles will be entrained by the escaping gas.

The features of claim 9 relates to the spreading of the briquetting of the material in the distributor zone over the entire width of the rolls. Particularly important is the number and shape of the distributing bars which, considered in the direction of rotation, have their leading portions at the center, i.e. at half the length of the distributor cage, and are bent or angled rearwardly toward their ends. Due to the rearward angling of the distributing bars, a force component is produced by which a satisfactory amount of material is displaced to the outsides. Fixed arms are secured in the front walls of the housing of the distributor zone, which project axially into the cylindrical distributor cage. The briquetting material arriving at the center of this transition level to the distributor zone is thus once more mixed with the material arriving at the outer edges. In this way, the briquetting mixture which may still not be quite uniform due to the unequal circumferential speeds is made homogeneous with simple means along the cage.

BRIEF DESCRIPTION OF THE DRAWINGS

In the following, the invention is explained in more detail by way of example with references to the accompanying FIGS. 1 to 4.

FIGS. 2 and 3 show a cross section respectively and a lengthwise section of the distributor zone including the distributor cage and the control flap below.

Figure 1:
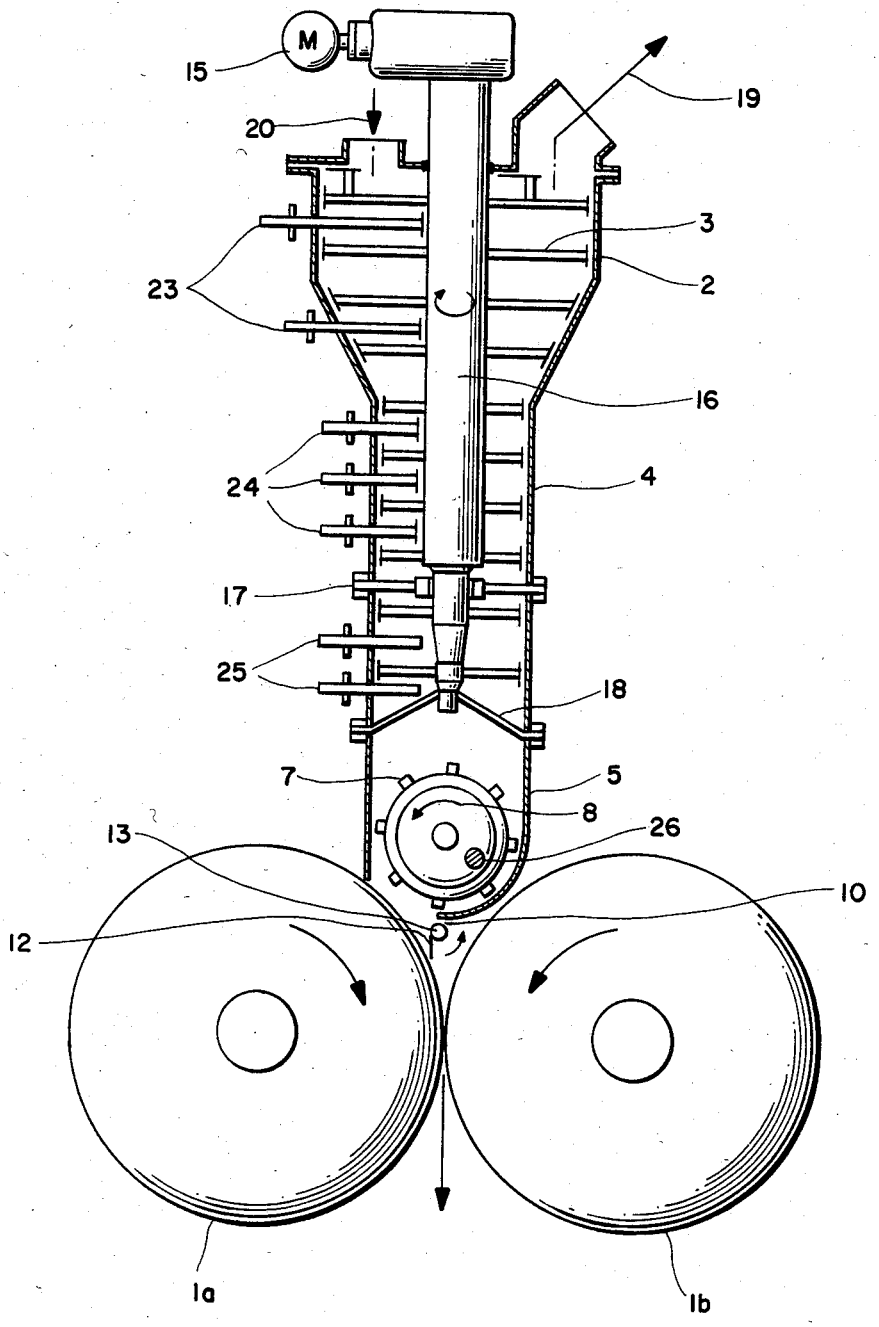
FIG. 1 shows the inventive traveling bed reactor comprising an upper and a lower pyrolysis regions and a distributor zone, and the two rolls of the press.

LIST OF REFERENCE NUMERALS (1*a*) fixed roll of the double roll press
(1*b*) movable roll of the double roll press
(2) upper, enlarged region of the mixing and kneading zone of the traveling bed reactor
(3) stirring arms
(4) lower region of the mixing and kneading zone of the traveling bed reactor
(5) distributor zone of the traveling bed reactor
(6) distributor cage
(7) distributing bars
(8) direction of rotation of (6)
(9) rearwardly angled ends of (7)
(10) outlet of (5)
(11) closing plates at the ends of the rolls
(12) control flap
(13) axis of rotation of (12)
(14) mount of (11)
(15) drive of the stirring arms
(16) vertical shaft of the stirring arms
(17) lower bearing for (16)
(18) lower bearing for (16)
(19) outlet for the degasification gas
(20) inlet for the mixture components
(21) molds on the circumference of the briquetting rolls (1*a*, 1*b*)
(22) drive shaft of the distributor cage
(23) fixed arms
(24) fixed arms
(25) fixed arms
(26) fixed arms

DESCRIPTION OF THE PREFERRED EMBODIMENT

Figure 4:
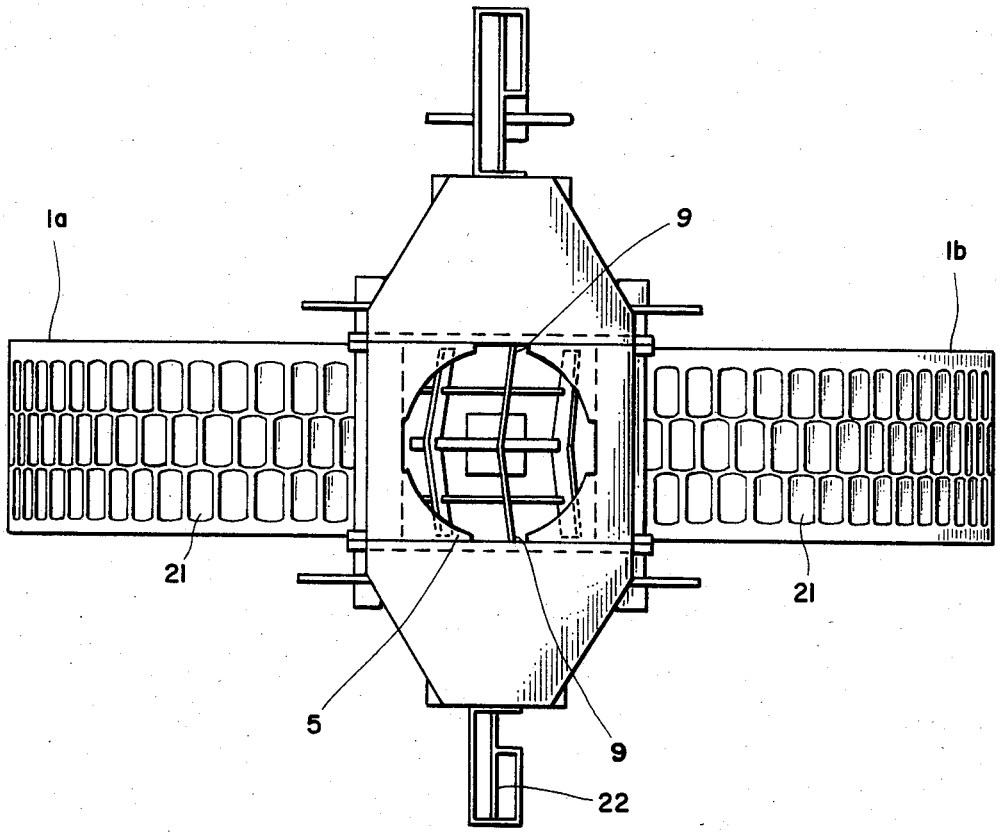
FIG. 4 is a top plan view of the distributor zone, with the housing open, so that the distributor cage with angled distributing bars is visible.

FIG. 1 diagrammatically shows the traveling bed reactor having an upper and a lower region 2,4 and a directly adjoining distributor zone 5 below, and a double roll press 1*a*,1*b*. The components having unequal temperatures are charged into the traveling bed reactor through at least two inlets 20. To the circumference of a vertically extending rotary shaft 16 having its drive 15 mounted above the traveling bed reactor, horizontally extending stirring arms 3 are uniformly secured at different levels. Further, an outlet 19 for the degasification gas is provided in an upper cover of the traveling bed reactor. Vertical stirring shaft 16 is guided below in bearings 17 and 18 which are supported by the inner walls of the traveling bed reactor. From the mixing and kneading zone the briquetting material passes directly into the distributor zone 5 where a distributor cage 6 is mounted for rotation about the horizontally extending shaft 22. On its circumference, distributor cage 6 is equipped with a number of distributor bars 7 by means of which the briquetting material is pressed into a lower lateral outlet 10 and uniformly spread over the length of the rolls. As shown particularly in the top plan view of FIG. 4, distributor bars 5 are centrally angled so that their end portions extend rearwardly, considered in the direction of rotation of the distributor cage 6. Due to this provision, the briquetting material is advantageously also shifted or mixed in the axial direction of the distributor cage. FIG. 4 also shows the two rolls in a view from above. One of the rolls 10 is fixed while the other is a movable roll 1*b* which is displaceable in the radial direction and is pressed with a definite, adjustable force against the fixed roll. On the circumference of the rolls, molds 21 for the briquettes are carried. FIGS. 2 and 3 show the distributor zone 5 separately, particlarly also the mounting of the distributor cage and the connection between the distributor bars and the central driving shaft. Below distributor cage, the amount of briquetting material is adjusted by means of a hinged control flap 12 pivoting about an axis 13. At the end of the rolls, closing plates 11 are provided which are secured at 14. Fixed arms 23, 24 and 25 project from the outer wall of the traveling bed reactor in the radial direction, and other fixed arms 26 extend inwardly in the axial direction. They may be distributed uniformly over the circumference of the traveling bed reactor, or they may be provided only unilaterally, as shown in FIG. 1.

We claim:

1. A method of preparing a material for hot briquetting through pyrolytic decomposition of bituminous coals in mixture with a two to five times larger volume of fine grained, thermally widely stable substances including at least one of anthracite, lean coal, coil coke, coke dust, sand, ores, phosphates, and fine-grained metal oxides, which do not bake below 650° C. and only unsubstantially soften, if not all, at a temperature between about 450° to 530° C. which has been adjusted by mixing the bituminous coal predried and preheated to the temperature at which it starts softening, with the thermally widely stable substances having a correspondingly higher initial temperature, comprising distributing the briquetting material over the width of a double-roll press and subsequently forming it in molds, characterized in that the briquetting material forming through pyrolytic decomposition of the bituminous coal component in the mixture is kept in a traveling bed reactor in a continuous mixing and kneading motion, initially in a rotational mixing and kneading motion taking place predominantly at levels parallel to the plane of the axes of rolls of the double-roll press, during which motion the material gradually sinks under gravity at an average speed of less than 3 centimeters per second, and toward the end in a rotational motion taking place almost perpendicularly thereto, by which it is uniformly spread over the entire width of the rolls.

2. A method of preparing a material for hot briquetting by pyrolytic decomposition in a traveling bed reactor, according to claim 1, characterized in that the rotational mixing and kneading motion predominantly at levels parallel to the roll axes is produced by at least one stirring mechanism whose stirring arms have an average circumferential speed of one to four meters per second, and with lower stirring and distributing arms rotating about a substantially horizontal axis have a circumferential speed of 0.5 to 2.5 meters per second.

3. A method of preparing a material for hot briquetting by pyrolytic decomposition in a traveling bed reactor according to claims 1 or 2, characterized in that the mixing and kneading motion performed at levels predominantly parallel to the roll axes is intensified by holding the briquetting material between the stirring and distributing arms rotating parallel to the roll axes, by means of fixed arms which project inwardly at the circumference of the traveling bed reactor.

4. A method of preparing a material for hot briquetting by pyrolytic decomposition in a traveling bed reactor according to claims 1 or 2, characterized in that the material is subjected to the mixing and kneading motion performed at levels predominantly parallel to the roll axes during at least four fifths of the total dwell time in the traveling bed reactor.

5. A method of preparing a material for hot briquetting by pyrolytic decomposition in a traveling bed reactor according to claim 4, characterized in that with an output of the press of more than 12 tons per hour, the total dwell time in the traveling bed reactor is less than 8 minutes.

6. A method of preparing a material for hot briquetting by pyrolytic decomposition in a traveling bed reactor according to claims 1 or 2, characterized in that at the bottom of the traveling bed reactor, the briquetting material is pressed out into a space secured against the atmosphere of the press chamber, which space is defined by elongated side walls, which are a portion of a cylindrical surface of one of the press rolls which is fixed, and the side facing this wall portion of a hinged control flap, forming a gate through which the prepared partly degassed and precompacted briquetting material is fed to the briquetting gap in substantially uniform distribution over the entire width of the rolls.

7. An apparatus for carrying out the method according to claim 1, including a traveling bed reactor comprising a vessel in which at least one stirring mechanism is mounted having a vertical axis of rotation and horizontal stirring arms, and a distributor zone is provided below which is formed a cylindrical distributor cage having a central horizontal axis, characterized in that in the upper region (2), the horizontally rotating stirring arms (3) are about 1.5 to 5 times longer than the stirring arms in the lower region (4).

8. An apparatus according to claim 7, characterized in that in the upper region (2), the outer diameter of the traveling bed reactor (1) is about 1.5 to 5 times larger than that in the lower region (4), and that a funnel-shaped transition zone is provided therebetween.

9. An apparatus according to claim 8, characterized in that the cylindrical distributor cage (6) is provided on its circumference with at least three uniformly distributed distributor bars (7) which extend in the axial direction and have, in the circumferential direction, one of a circularly arcuate, angular and or polygonal configuration, with the central portion leading and the two ends trailing in the direction of rotation (8).

10. An apparatus to claim 9, characterized in that fixed arms (26) are provided on the front walls of the housing of the distributor zone, which arms project in the axial direction into the cylindrical distributor cage.

11. An apparatus according to claim 10, characterized in that the lower cross section at the transition to the distributor zone of the traveling bed reactor has one of a round and oval configuration.

12. An apparatus according to claim 11, characterized in that the diameter of the round cross section, or the length of the oval cross section, approximately corresponds to the width of the briquetting rolls.

* * * * *